US006808172B2

(12) United States Patent
Bedford et al.

(10) Patent No.: US 6,808,172 B2
(45) Date of Patent: Oct. 26, 2004

(54) BOARD GAME

(75) Inventors: Jonathan Bedford, Hawthorne, CA (US); Brian Yu, Hawthorne, CA (US)

(73) Assignee: Mattel, Inc., El Segundo, CA (US)

( * ) Notice: Subject to any disclaimer, the term of this patent is extended or adjusted under 35 U.S.C. 154(b) by 0 days.

(21) Appl. No.: 10/286,189

(22) Filed: Nov. 1, 2002

(65) Prior Publication Data

US 2003/0085520 A1 May 8, 2003

Related U.S. Application Data

(60) Provisional application No. 60/350,270, filed on Nov. 2, 2001.

(51) Int. Cl.[7] ..... A63F 3/00

(52) U.S. Cl. ..... 273/255; 273/243; 273/292

(58) Field of Search ..... 273/255, 262, 273/294, 308, 293, 292, 243, 287

(56) References Cited

U.S. PATENT DOCUMENTS

| | | | | |
|---|---|---|---|---|
| 1,125,867 | A | | 1/1915 | Mohr |
| 1,527,059 | A | | 2/1925 | Morgan et al. |
| 1,642,424 | A | | 9/1927 | Massey |
| 1,988,273 | A | | 1/1935 | Frost |
| 2,159,563 | A | | 5/1939 | McNaney |
| 3,263,999 | A | | 8/1966 | McCoy |
| 3,411,221 | A | | 11/1968 | Clark |
| 3,492,000 | A | | 1/1970 | Board |
| 3,572,718 | A | | 3/1971 | Moore |
| 3,767,199 | A | | 10/1973 | Board |
| 3,883,142 | A | | 5/1975 | Spohn |
| 3,951,411 | A | * | 4/1976 | Hill et al. ..... 273/243 |
| 4,124,214 | A | | 11/1978 | Pavis |
| 4,165,878 | A | | 8/1979 | Frain |
| 4,202,546 | A | | 5/1980 | Bromberg |
| 4,340,231 | A | | 7/1982 | Cammarata |
| 4,480,838 | A | | 11/1984 | Aharonian |
| 4,629,195 | A | | 12/1986 | Charney |
| 4,671,515 | A | | 6/1987 | Burgess |
| 4,780,162 | A | | 10/1988 | Forler et al. |
| 4,840,382 | A | * | 6/1989 | Rubin ..... 463/9 |
| 4,932,667 | A | | 6/1990 | Gorski et al. |
| 4,941,668 | A | | 7/1990 | Mobrem |
| 4,949,975 | A | | 8/1990 | Carrier |
| 5,077,796 | A | | 12/1991 | Bellaire |
| 5,190,292 | A | | 3/1993 | Perry |
| 5,259,623 | A | | 11/1993 | Kanelos, Sr. |
| 5,265,879 | A | | 11/1993 | Garcon et al. |
| 5,318,306 | A | | 6/1994 | Levin |
| 5,478,086 | A | | 12/1995 | Aylett |
| 5,516,290 | A | | 5/1996 | Quigley et al. |
| 5,611,537 | A | | 3/1997 | Burtt |
| 5,662,327 | A | | 9/1997 | Levinrad |
| 5,662,332 | A | | 9/1997 | Garfield |
| 5,743,529 | A | | 4/1998 | Haynes |
| 5,810,359 | A | | 9/1998 | Wilkins et al. |
| 5,810,666 | A | | 9/1998 | Mero et al. |
| 5,951,013 | A | | 9/1999 | Campanella |
| 5,954,332 | A | | 9/1999 | Mero et al. |
| 6,019,371 | A | | 2/2000 | Mantis |
| 6,267,375 | B1 | | 7/2001 | Bernstein et al. |

* cited by examiner

*Primary Examiner*—Vishu K. Mendiratta
(74) *Attorney, Agent, or Firm*—Kolisch Hartwell, P.C.

(57) ABSTRACT

The present invention provides rules and apparatus for playing a board game. The game includes a decoder for each of the plurality of players, a set of coded game cards having a plurality of possible probability influencing indicia printed thereon. The decoders are configured to select at least one of the probability influencing indicia from the game card. Further, the game includes a value generator configured to generate a value based on the selected probability influencing indicia. The generated value determines a winner.

27 Claims, 6 Drawing Sheets

BOARD GAME

CROSS-REFERENCE TO RELATED APPLICATIONS

This applications claims priority to U.S. Provisional Patent Application Ser. No. 60/350,270 filed on Nov. 2, 2001 and entitled "BOARD GAME".

FIELD OF THE INVENTION

The present invention relates generally to board games. More specifically, the present invention relates to rules and apparatus for playing a board game for multiple players.

BACKGROUND OF THE INVENTION

Examples of board games wherein players move around a board to visit different locations to acquire game components are disclosed in U.S. Pat. Nos. 1,125,867, 3,883,142, 3,572,718, 4,629,195, 5,190,292, 5,478,086, 5,516,290, 5,611,537, 5,662,327, 5,810,359 the disclosures of which are incorporated by reference in their entirety for all purposes.

Examples of board games utilizing more than one path are disclosed in U.S. Pat. Nos. 3,883,142 3,572,718, 4,480,838, 4,629,195, 4,949,975, 5,259,623, 5,265,879, 5,662,327, 5,743,529, 5,810,359, 6,019,371, the disclosures of which are incorporated by reference in their entirety for all purposes.

Examples of games using coded game cards and decoders are disclosed in U.S. Pat. Nos. 1,642,424, 1,988,273, 2,159,563, 3,263,999, 3,411,221, 4,165,878, 4,780,162, 4,941,668, the disclosures of which are incorporated by reference in their entirety for all purposes.

SUMMARY OF THE INVENTION

The present invention provides rules and apparatus for playing a board game. The game includes a decoder for each of the plurality of players, a set of coded game cards having a plurality of possible probability influencing indicia printed thereon. The decoders are configured to select at least one of the probability influencing indicia from the game card. Further, the game includes a value generator configured to generate a value based on the selected probability influencing indicia. The generated value determines a winner.

An object of the game is for players to battle one another for puzzle pieces using coded game cards, player specific decoders, and value generators in order to obtain all of a set of puzzle pieces and assemble a puzzle. The game is turn based, and the players travel around a game board and battle for coded game cards and puzzle pieces.

The advantages of the present invention will be understood more readily after consideration of the drawings and the Detailed Description.

DETAILED DESCRIPTION OF THE INVENTION

Figure 4:
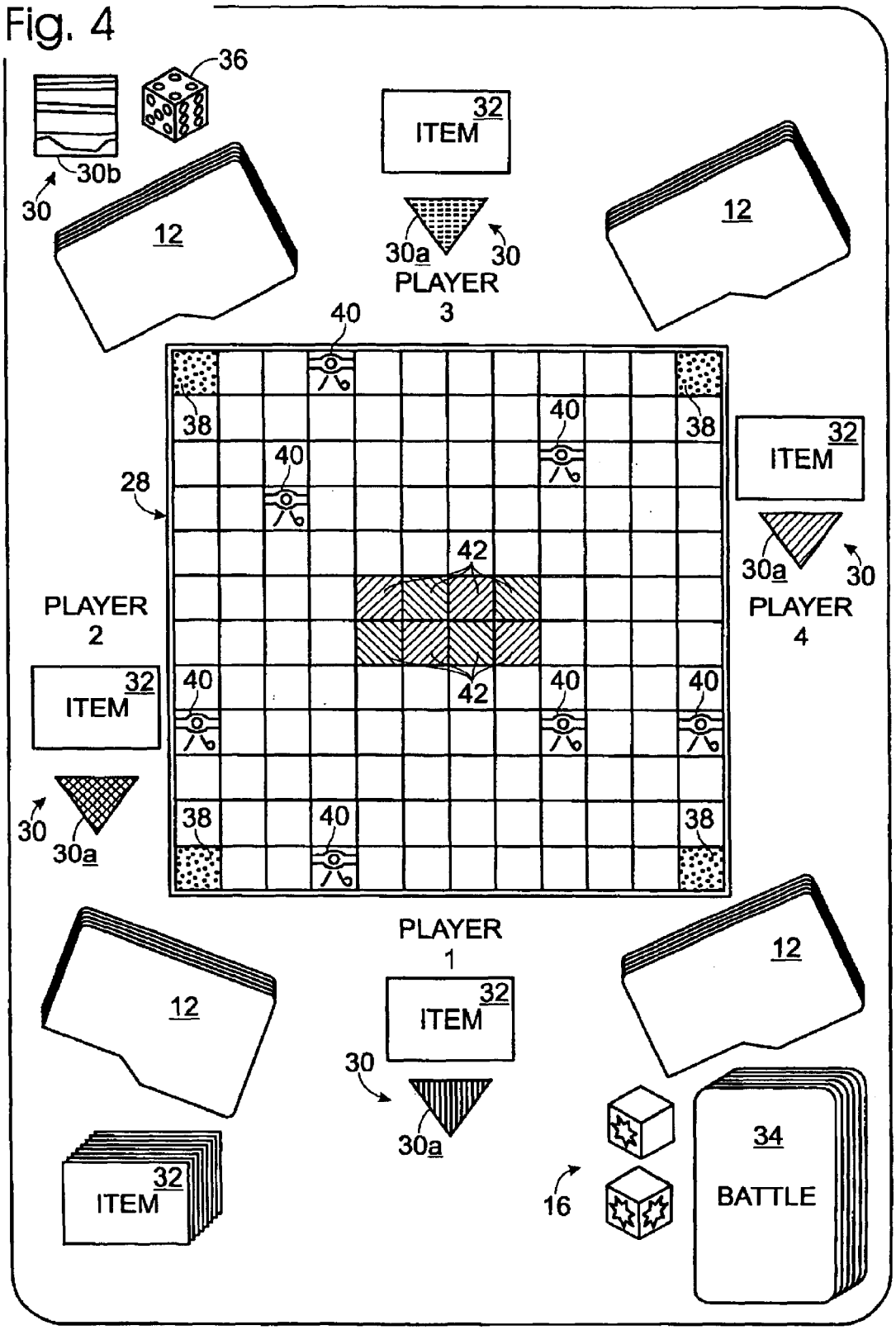
FIG. 4 depicts one embodiment of a game board and playing pieces suitable for use with the game of the present invention.

The present invention is a game played by at least two players. The game requires that players take turns moving playing pieces around a game board while trying to collect a set of puzzle pieces from other players through a battle process. In one embodiment, the game may be based on a well-known popular culture phenomenon, such as a comic book or cartoon. For example, the embodiments of the present invention shown in FIGS. 1, 2 and 4 are based on the popular children's comic book YU-GI-OH, by Kazuki Takahashi, and players of the game take on the rolls of characters from the comic book and engage in monster battle duels between each other.

Figure 1:
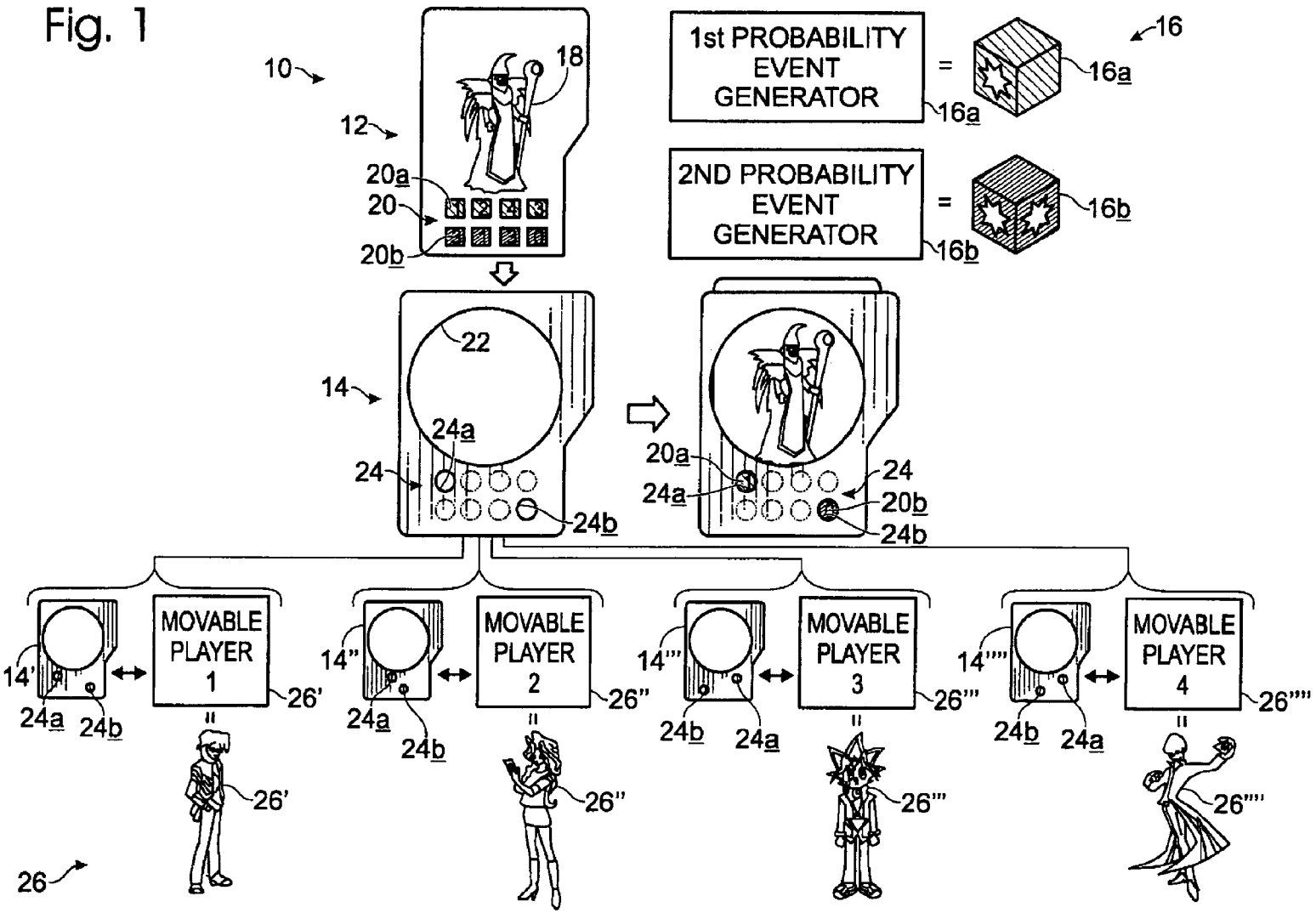
FIG. 1 is a schematic representation of a coded game card, a player-specific game-card decoder, and value generators according to an embodiment of the present invention.
Figure 2:
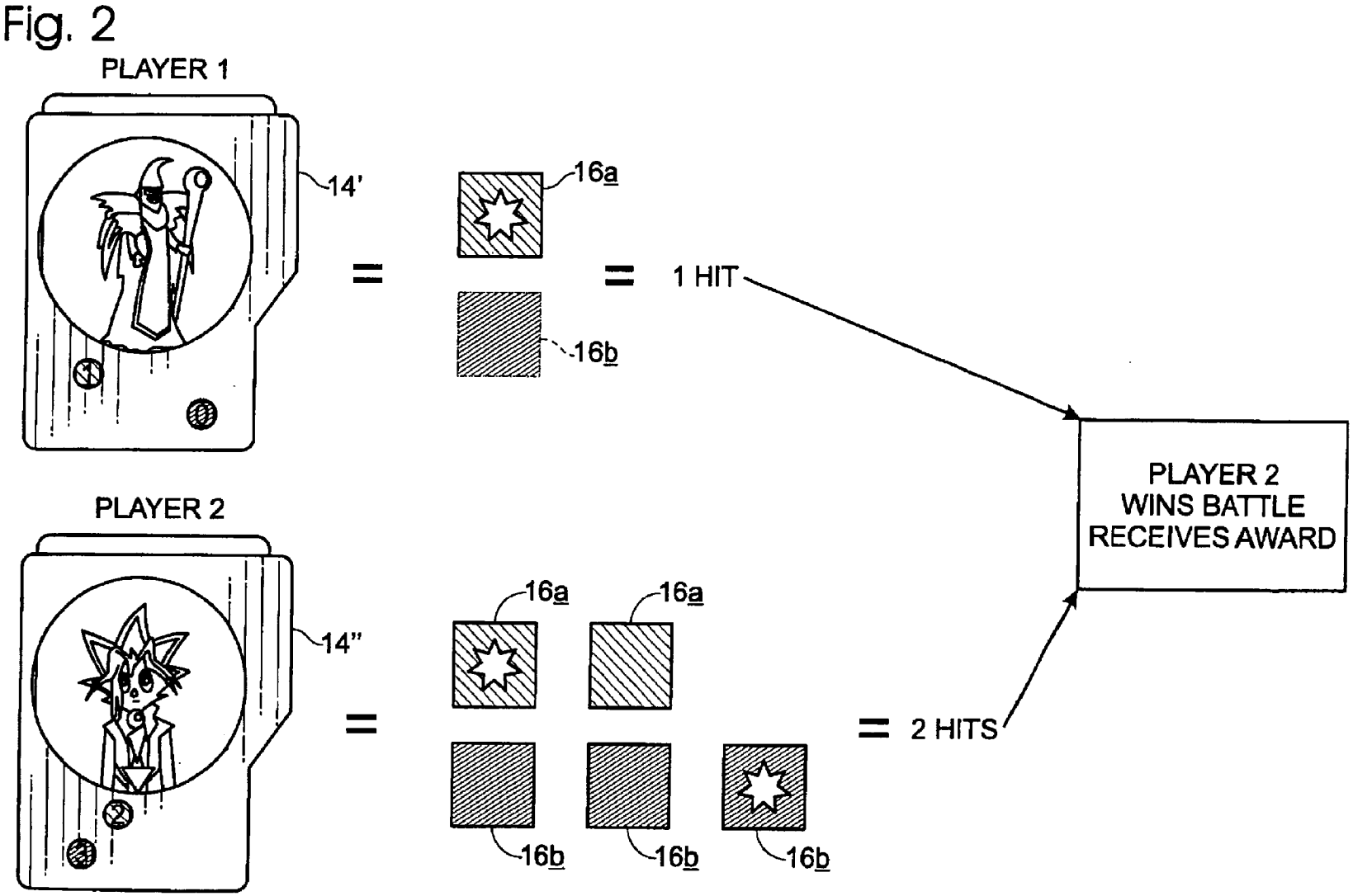
FIG. 2 is a schematic depiction of players engaging in a battle according to an embodiment of the game of the present invention.

Battle components for the game are generally indicated at 10, in FIG. 1. The game may include a set of game cards 12, configured for inserting into a player-specific decoder 14. Game cards 12 and decoder 14 combine to govern a player's use of a value generator 16, typically a die. Players compare values generated by value generator 16 during the game to determine a winner in a game battle.

In an embodiment based on the comic book YU-GI-OH, game cards 12 are referred to as monster sliders. Each game card 12 of the set may include a game card icon 18 printed thereon configured to identify and distinguish each game card of the set. In the monster slider embodiment of the game cards, icons 18 are different monster characters from the comic book.

A plurality of probability influencing indicia 20 may be printed in a predefined region of each game card 12. The probability influencing indicia may include a set of first probability influencing indicia 20*a* and a set of second probability influencing indicia 20*b*. As shown in FIG. 1, first probability influencing indicia 20*a* includes a row of discretely positioned numbers. Similarly, second probability influencing indicia 20*b* includes a row of discretely positioned numbers.

During game play the first set of probability influencing indicia 20*a* determine a number of times that a first value generator 16*a* is used. Similarly, during game play the second set of probability influencing indicia 20*b* determine a number of times that a second value generator 16*b* is used. In the context of the comic book YU-GI-OH embodiment of the game, this enables different monsters sliders to have different fighting or battling abilities depending upon which player is decoding the game card/monster slider.

Game cards 12 may be inserted into decoder 14 to reveal at least one selected probability influencing indicia 20. Decoder 14 may include a character window 22 configured for viewing game card icon 18, while game card 12 is inserted into decoder 14. A set of decoder apertures 24 may be positioned on decoder 14 to align with the predefined region of each game card 12, which has probability influencing indicia 20 printed thereon. In the embodiment shown in FIG. 1, decoder 14 includes two decoder apertures 24*a* and 24*b*, one positioned to select one of the set of first probability influencing indicia 20*a* and one positioned to select one of the set of second probability influencing indicia 20*b*.

The selected first probability influencing indicia 20*a* governs the use of first value generator 16*a*, and the selected second probability influencing indicia 20*b* governs the use of second value generator 16*b*. First value generator 16*a* may be a die, as shown in FIG. 1, having a first number of sides marked with a "hit" indicator and the remaining sides marked with a "no hit" indicator. Similarly, second value generator 16*b* may be a die having a second number of sides marked with a "hit" indicator and the remaining sides marked with a "no hit" indicator.

It will be understood that first and second value generators, 16*a* and 16*b* may be any suitable device for randomly generating a value. Examples of devices for randomly generating values include dice, spinners, cards drawn from a shuffled deck, electronic number generators, and software for randomly generating a number.

Probability influencing indicia 20 may be a number printed in discrete locations on game cards 12. Each number may represent the number of times a die is rolled in order to generate a value. For example, as shown in FIG. 1, first probability influencing indicia 20*a* is the number "1" and second probability influencing indicia 20*b* is the number "0". Therefore, for the example illustrated in FIG. 1, first probability influencing indicia 20*a* determines that first value generator 16*a* is rolled one time. In the same way, second probability influencing indicia 20*b* determines that second value generator 16*b* is not rolled at all.

The probability of scoring a hit with first value generator 16*a* may be different than the probability of getting a hit with second value generator 16*b*. For example, first value generator 16*a* may be a six-sided die including three sides marked with a "hit" indicator. The remaining sides may be marked with a "no hit" indicator. Second value generator 16*b* may be a six-sided die including two sides marked with a "hit" indicator. The remaining sides may be marked with a "no hit" indicator.

Other combinations of numbers of sides of dice or numbers of hit indicators per dice may be used to vary the probability of scoring a "hit." Other types of value generators may also be configured to produce variations in the probability of scoring a hit. Moreover, numerous combinations of indicia types and value generator types may be used in accordance with embodiments of the present invention.

Decoders 14 are keyed to, or associated with, movable player pieces 26. There may be a plurality of movable player pieces 26. Each decoder 14 may have a different positioning of decoder apertures 24, as illustrated in FIG. 1 by the dashed apertures on decoder 14. By having different aperture positioning each decoder 14 reveals at least one probability influencing indicia 20 unique to that decoder.

FIG. 1 shows that there may be four movable player pieces 26 and four decoders 14, in an embodiment of the game. First movable player piece 26' is keyed to a first decoder 14' having decoder apertures 24*a* and 24*b* in a first set of positions. Second movable player piece 26" is keyed to a second decoder 14" having decoder apertures 24*a* and 24*b* in a second set of positions. Third movable player piece 26'" is keyed to a third decoder 14'" having decoder apertures 24*a* and 24*b* in a third set of positions. Fourth movable player piece 26"" is keyed to a fourth decoder 14"" having decoder apertures 24*a* and 24*b* in a fourth set of positions.

Each decoder reveals different probability influencing indicia 20 for any one of the game cards inserted because each decoder 14 has a different set of positions for decoder apertures 24*a* and 24*b*. Each player has a different likelihood of success in a game card battle with each game card of the set of game cards because different probability influencing indicia 20 are revealed when a game card is inserted into different decoders and the decoders being keyed to a specific movable player piece.

Figure 3:
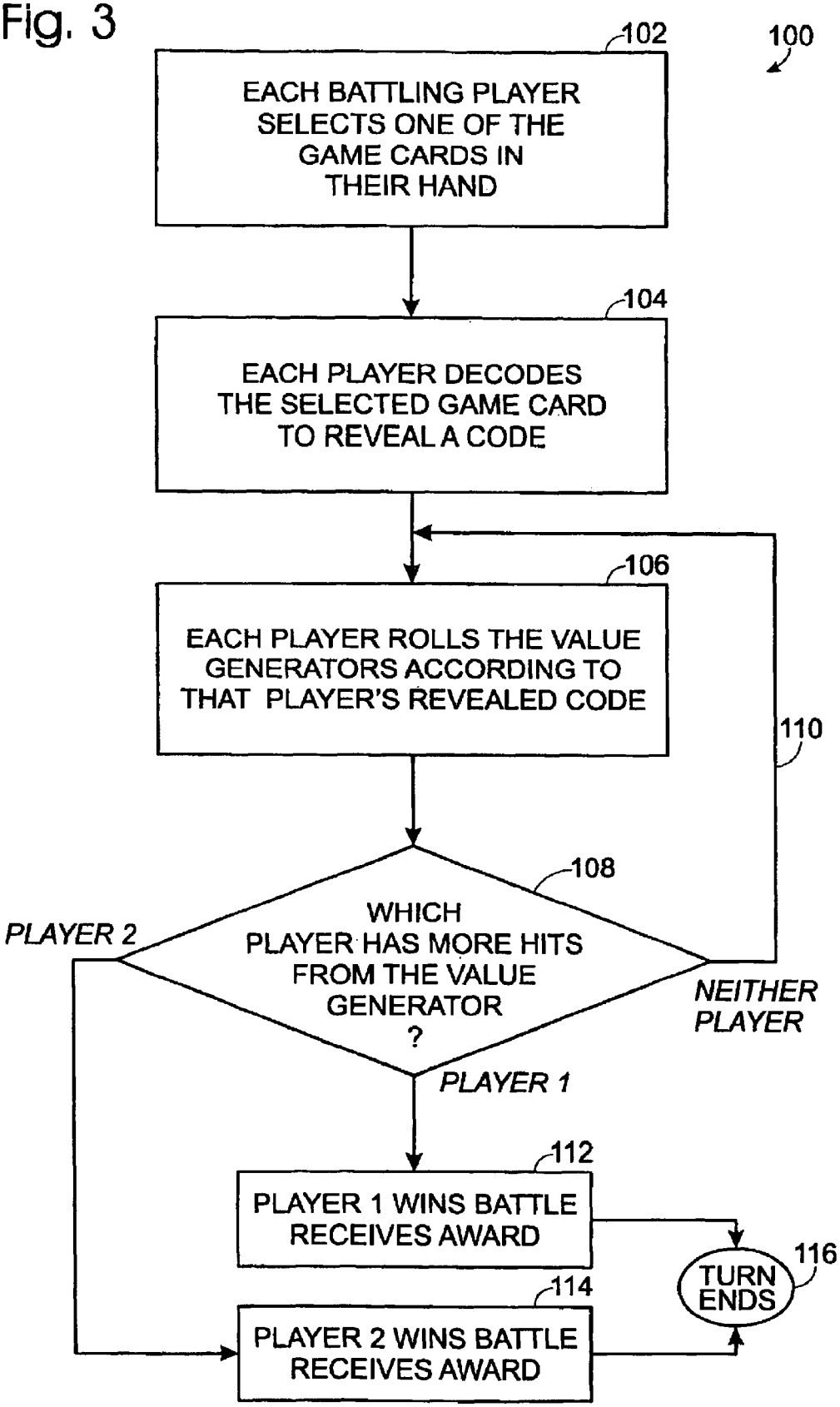
FIG. 3 is a flow chart describing the battle of FIG. 2.

Game card battles occur during play of the game. A game card battle is illustrated in FIGS. 2 and 3. A game card battle occurs during a player's turn, between the player whose turn it is and another player. Each of the two players selects a game card from the player's own hand and inserts the selected game card into his or her decoder. The decoder reveals a player-specific code, or set of probability influencing indicia, that then governs that player's use of one or more value generators to determine a number of "hits." The player with the most "hits" wins the battle.

As shown in FIG. 2, first player decoder 14' has a game card 12 from the first player's hand inserted therein. Similarly, second player decoder 14" has a different game card 12 selected from the second player's hand inserted therein. The first player's decoder 14' reveals a number "1" through decoder aperture 24*a* and a number "0" through decoder aperture 24*b*. The second player's decoder 14" reveals a number "2" through decoder aperture 24*a* and a number "3" through decoder aperture 24*b*.

The first player uses first value generator 16*a* one time as indicated by the revealed number "1" and uses second value generator 16*b* zero times as indicated by the revealed number "0". The second player uses first value generator 16*a* two times as indicated by the revealed number "2" and uses the second value generator 16*b* three times as indicated by the revealed number "3". As an example, the first player scored only one "hit," and the second player scored two "hits." Therefore, in the example battle between the first and second players shown in FIG. 2, the second player wins the battle by scoring two "hits" to the first player's one "hit."

The winning player receives an award, for example, the winning player may take the losing player's game card, or the winning player may take the winning player's puzzle pieces. Determining the type of award the winning player receives will be explained in more detail below.

A flow chart illustrating a battle between two players is shown in FIG. 3, generally indicated by 100. When two players engage in a battle, each player selects one of the game cards from his or her hand of game cards, as indicated at 102. Each of the two competing players inserts a selected game card into a decoder to reveal a code, or set of probability influencing indicia, as indicated at 104. Both players use the first and second value generators according to the revealed code, as indicated at 106. In embodiments where the first and second value generators are dice, the players roll each die the appropriate number of times.

The values generated by each player are compared to determine which player has more "hits," as indicated at 108. If the players are tied in the number of "hits" scored then the players use the first and second value generators according to the revealed code again, as indicated by the return arrow 110. If player 1, the first player, scores more "hits," then player 1 receives an award, as indicated at 112. If player 2, the second player, scores more "hits," then player 2 receives an award, as indicated at 114.

The award, as discussed below, will depend on the context within the game that the battle takes place. In some contexts the award will be the opposing player's game card, and in other contexts the award will be the opposing player's puzzle pieces. After the winning player receives an award, the player who initiated the battle ends his turn, as indicated at 116.

A typical game board set up is illustrated in FIG. 4. A game board 28 may be positioned with a player space on each side of the game board. Each player begins the game with one puzzle piece from a set of puzzle pieces 30. There may be two types of puzzle pieces in the set, distributed puzzle pieces 30*a,* which are equally distributed among the players at the start of play, and a winning puzzle piece 30*b*.

A set of item cards 32 may be positioned around game board 28. Each player may have one or more item card 32 in the player's space surrounding the game board. Item cards 32 may be used during the game and may include various instructions printed thereon to affect play of the game. For example, the item card may instruct a player to:

add a "hit" to the player's score during a battle;

count a "miss" as two "hits" to add to the player's score during a battle;

to take another turn;

to take a game card from one of the other players;

to summon other players to a battle in the battle arena;

to search through another player's item cards and take one of them;

to summon another player for a battle outside the battle arena;

to move twice the number of spaces rolled; and to skip one of the other player's turns.

Each item card 32 may include a war number in one corner of the card. A war number may be used in one of the types of battles that may be engaged in between players, as will be explained in more detail below.

A set of battle type cards 34 may be positioned at one corner of game board 28. As will be explained in detail below, players engage in battles outside a battle arena for game cards 12, and inside the battle arena for puzzle pieces 30. For battles outside the battle arena, a battle type must be determined; all battles inside the arena are game card battles, such as described above, with reference to FIGS. 2 and 3.

Battle type cards 34 include three different types, each type determining how competing player's battle one another. A first type of battle is a hand signal battle. In an embodiment of the game based on the comic book YU-GI-OH, the hand signal battle is called "Janken." The second battle type is an item card war battle. In an embodiment of the game based on the comic book YU-GI-OH, the item card war battle is called "Ikusa." The third battle type is a dice battle. In the embodiment of the game based on the comic book YU-GI-OH, the dice battle is called "Saikoro."

To conduct a hand signal battle, each player makes a fist and shakes the fist in the air three times. On the third shake each player makes one of three signals with his or her hand. First, each player may make a "paper" signal that consists of extending their hand palm down with his or her fingers together. Second, each player may make a "rock" signal that consists of a closed fist. Third, each player may make a "scissors" signal that consists of a closed fist with the index finger and middle finger extending from the closed fist.

The winner is determined by comparing the hand signals of the competing players. A "paper" signal beats a "rock" signal, a "rock" signal beats a "scissors" signal, and a "scissors" signal beats a "paper" signal. If two players make the same signal the process is repeated until one of the players wins.

To conduct an item card war battle, each player must shuffle item cards 32 that they have in their hand. Each player then fans out their item cards 32 face down in front them. Each player then chooses one item card from their opponent's fan of item cards and flips it over in front of their opponent. The players then compare the war number in the corner of the flipped item cards. The player who has the higher number wins. If the players have a tie, they repeat the process by flipping another one of their opponent's item cards over.

To conduct a dice battle, players each roll the value generators three times and total the number of "hits" scored for the three rolls. The player with the most number of "hits" wins the dice battle. If the players have a tie, they repeat the process by rolling the value generators three times each and comparing the number of "hits" scored.

When a player wins any one of the battle types outside of the arena, that player gets to take a game card from the losing player as an award. If the opposing player does not have any game cards, the winning player may take an item card from the losing player as an award. If the losing player has neither game cards nor item cards the losing player looses his or her next turn as an award for the winning player.

Players may use a random number generator 36 during their turn to determine the number of spaces on game board 28 that the player may move. Any suitable random number generator may be used. Players move around game board 28 to acquire item cards 32 and game cards 12, to battle one another, and to enter the battle arena to compete for puzzle pieces 30. A player may move up to the number of spaces indicated by random number generator 36.

Game board 28 includes a variety of different types of spaces that a player may occupy with his or her moveable player piece 26, during play of game 10. A card shop space 38 may be positioned at each of the four corners of game board 28. Each card shop space is associated with one of the movable player pieces 26. When a player lands on a card shop space the player may draw a game card from a game card deck associated with that card shop. If a player has more than three game cards the player may select a game card and discard it. Discarded game cards go to the bottom of the stack adjacent a card shop.

Game board 28 also includes item card spaces 40 positioned at various locations around board 28. When a player lands on an item card space 40, the player may draw an item card from the item card deck. If the player has more than four item cards, then the player must select one to discard to the bottom of the item card deck.

Game board 28 further includes a set of battle arena spaces 42 positioned near the center of game board 28 forming a battle arena. Game card battles take place inside the battle arena. A player competes for puzzle pieces 30 while battling in the battle arena. The battles conducted between players in the battle arena are game card battles, as described above, with reference to FIGS. 2 and 3.

Play of the game will be further described with reference to FIGS. 5A and 5B. A method of the playing game is indicated generally at 200, in FIGS. 5A and 5B. A player starts playing the game by rolling a dice to determine a number of spaces to move during the players turn, as indicated at 202. The player moves his or her movable playing piece in any direction on the game board any number of spaces up to the number rolled on the die, as indicated at 204.

The player decides if they would like to play an item card during this turn, as indicated at 206. If the player plays an item card, the player follows the instructions on the item card, as indicated at 208. Depending on the contents of the item card that the player plays the player's turn may end, as indicated at 210, or the player may proceed to determine what type of space the player has landed on, as indicated at 212. Different item cards are suitable for play at different times during a player's turn.

If the player has decided not to play an item card at that point in his or her turn, the player may proceed to determine what type of space the player has landed on, as indicated at 212. The player may be on one of four types of spaces. First, the player may be on a card shop space. Second, the player may be on an unmarked space that is adjacent another player. Third, the player may be on an item card space. Fourth, the player may be on a battle arena space. The type of space the player is on determines what the player can do during his or her turn. If the player is on a battle arena space, then he or she may summon another player to the battle arena and a battle takes place, as described in FIG. 5 at 100.

If the player is on a card shop space, the player retrieves a game card from the associated game card stack, as indicated by card shop space arrow 214 and at 216. If the player is on an item card space, the player draws an item card, as indicated by arrow 218 and at 220. If the player is on an unmarked space that is adjacent another player, the two players may engage in a battle, as indicated by arrow 222 and space 224.

After landing on a card shop space and retrieving a game card from the associated game card stack, at 216, a player determines if he or she has more than three game cards in his or her hand, at 226. If the player has more than three game cards, the player discards a game card, at 228. Then the player's turn ends, at 230. If the player does not have more than three game cards in his or her hand, the player's turn ends, at 230.

After landing on the item card space and drawing an item card, as indicated at 220. The player determines if he or she has more than four item cards in his or her hand, at 232. If the player does have more than four item cards in his or her hand, the player discards an item card, as indicated at 234. Then the player's turn ends, as indicated at 210. If the player does not have more than four item cards in his or her hand then the player's turn ends, as indicated at 210.

After landing on a space adjacent another player, the player whose turn it is determines if they would like to battle the adjacent player, as indicated at 224. If the player decides not to battle, the player's turn is over, as indicated at 230. If the player decides to battle the adjacent player, the player draws a battle card, as indicated at 238. As noted above, there are three types of battle cards: a hand signal battle card, an item card battle card, and a dice battle card. For ease of discussion, the player whose turn it is will be referred to as "player 1," and the adjacent player whose turn it is not will be referred to as "player 2."

Figure 5A:
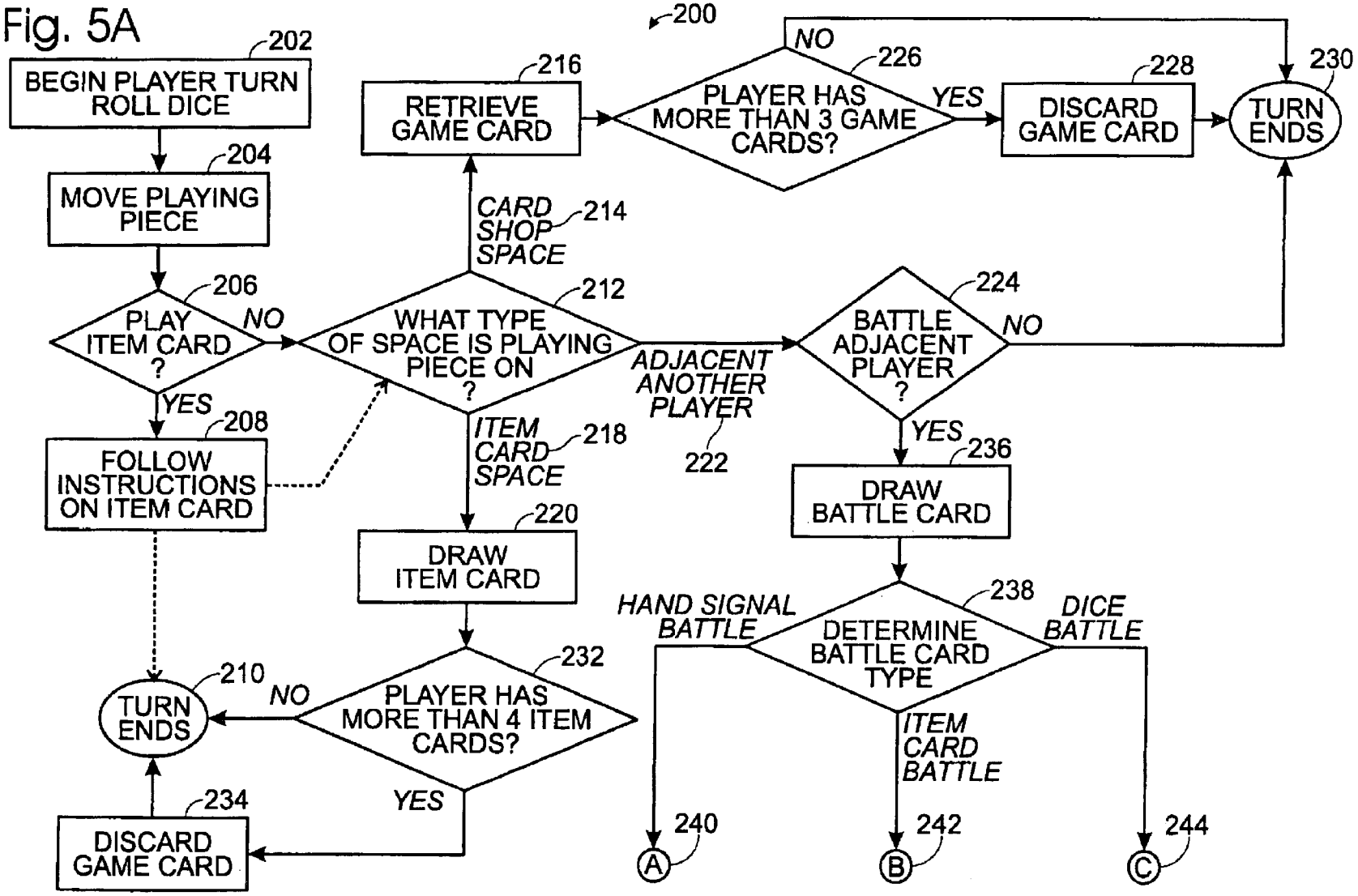
FIG. 5A is a flow chart describing a method of play of an embodiment of the game of the present invention.
Figure 5B:
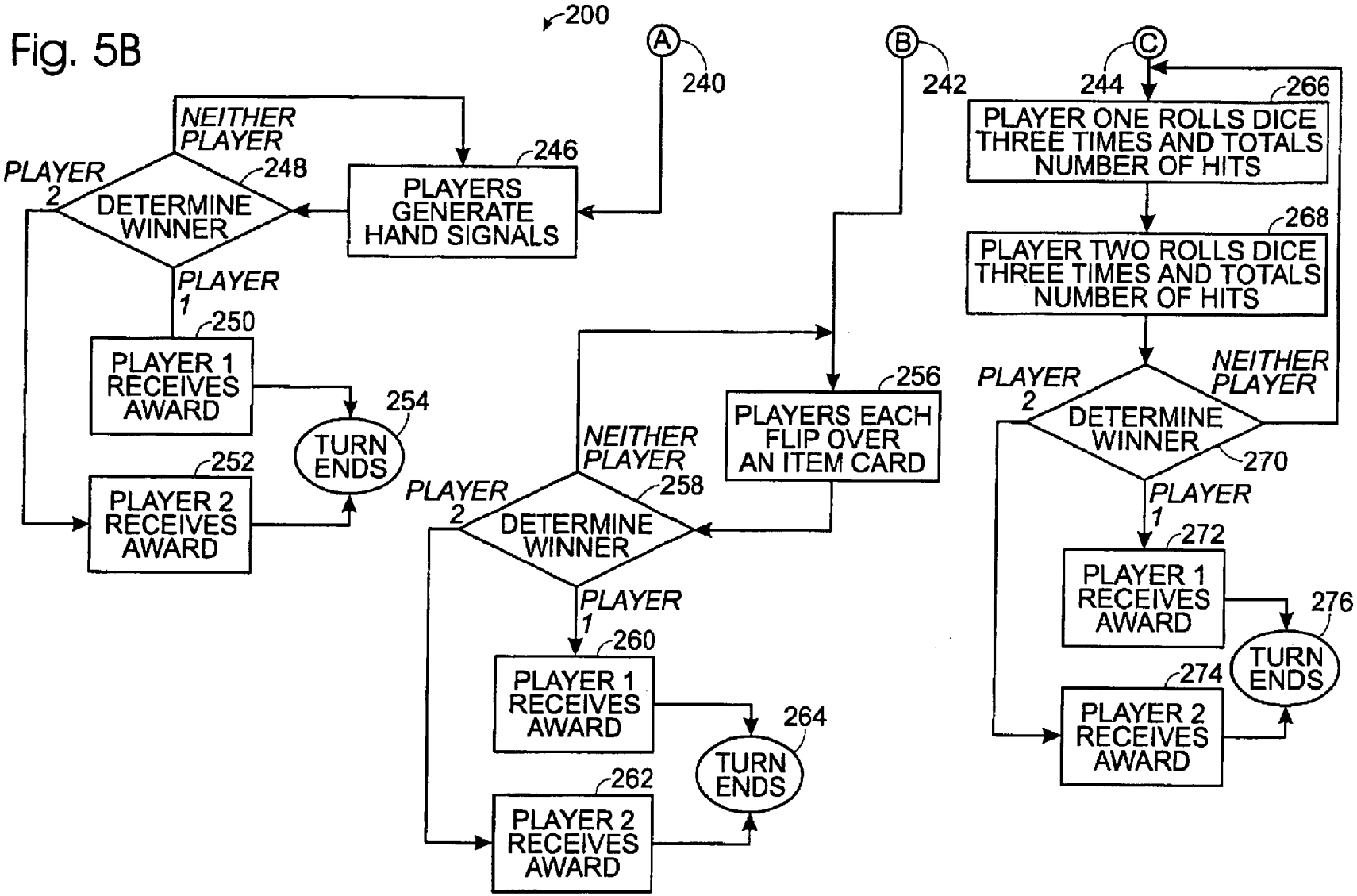
FIG. 5B is a flow chart describing a method of play of an embodiment of the game of the present invention.

If "player 1" draws a hand signal battle card, play proceeds to branch A of the flow chart, at 240 in both FIGS. 5A and 5B. If "player 1" draws an item card battle card, play proceeds to branch B of the flow chart, at 242 in both FIGS. 5A and 5B. If "player 1" draws a dice battle card, play proceeds to branch "C" of the flow chart, at 244 in both FIGS. 5A and 5B.

Turning to FIG. 5B, if "player 1" draws a hand signal battle card, both "player 1" and "player 2" simultaneously generate hand signals, as indicated at 246. The generated hand signals are compared to determine a winner, at 248. As discussed above, a "paper" signal beats a "rock" signal, a "rock" signal beats a "scissors" signal, and a "scissors" signal beats a "paper" signal. If there is a tie and neither player wins, then the players generate hand signals again, as indicated at 246. If "player 1" wins the hand signal battle, then "player 1" receives an award, as indicated at 250. If "player 2" wins the hand signal battle, then "player 2" receives an award, as indicated at 252. Typically, the award is one of the opposing player's game cards or item cards as discussed above. After either "player 1" or "player 2" has won, the turn ends, as indicated at 254.

If "player 1" drew an item card battle card then both "player 1" and "player 2" shuffle and fan out their item cards face down. "Player 1" flips over one of "player 2's" item cards and then "player 2" reciprocates, flipping over one of "player 1's" item cards, as indicated at 256. The winner is the player with the highest item card number in the corner of the item card from that player's hand that was flipped, as indicated at 258.

For example, "player 1" may be the winner if the card from "player 1's" hand that "player 2" flipped has the higher number in the corner. In that case, "player 1" receives an award, as indicated by 260. If the card from "player 2's" hand that "player 1" flipped has the higher of the two numbers printed in the corner, then "player 2" is the winner and receives an award, as indicated at 262. After a winner has been determined and an award received, "player 1's" turn ends, as indicated at 264.

Finally, if "player 1" draws a dice card, then "player 1" rolls both value generators, also known as dice, three times and totals the number of "hits" scored, as indicated at 266. Next "player 2" rolls both value generators three times and totals the number of "hits" scored, as indicated at 268. A winner is determined by comparing the number of "hits" that each player scored, as indicated at 270. If "player 1" scored more "hits" then "player 1" receives an award, as indicated at 272. If "player 2" scores more "hits" then "player 2" receives an award, as indicated at 274. After one of the two players receives an award the turn ends, as indicated at 276. If there is a tie, both players repeat the process until a winner is determined.

Play proceeds around the game board and the next player begins his or her turn. The game is won when one of the players succeeds in acquiring all of the puzzle pieces. Battles for puzzle pieces take place in the battle arena.

Three examples of possible directions for a game according to the present invention are included below. Examples below are based on the popular children's comic book YU-GI-OH, by Kazuki Takahashi, and players of the game take on the rolls of characters from the comic book and engage in monster battle duels between each other. Other popular comic books, movies, television programs, and popular culture phenomenon may be used as a basis for a game in accordance with the present invention.

EXAMPLE I

YU-GI-OH Board Game

Game Contents
- 1 Game board
- 1 Six-sided numbered die
- 2 Battle dice
  - 1 Green (3 hit and 3 miss symbols)
  - 1 Blue (1 hit and 5 miss symbols)
- 4 Character movers
  - 1 Yugi (Purple)
  - 1 Seto (Gray)
  - 1 Tea (Blue)
  - 1 Joey (Green)
- 4 Slider Readers
  - 1 Purple
  - 1 Gray
  - 1 Blue
  - 1 Green 28 Trap Tiles
24 Monster Sliders
3 Battle Cards
5 Millennium Puzzle Pieces The Object Gather powerful monsters and battle other players in the Arena to win their piece of the Millennium Puzzle. The first player to obtain all five pieces wins the game.

Game Set-Up

Open the game board in the center of the playing area.

Place all of the Slider Readers face down in the middle of the board. Each player draws one. This assigns the character that they will play.

Each player takes the mover associated with their Slider Reader and places it in the Card Shop that matches their mover's color.

Shuffle the Monster Sliders and deal them into four piles. Place one pile under each corner of the board where the four Card Shops are located.

Each player draws one Monster Slider from their Card Shop and places it in their Slider Reader.

Shuffle the Trap Tiles and deal two to each player, then place the Trap deck beside the board.

Shuffle the Battle Cards and place them in the Arena.

Each player takes one of the triangular pieces of the Millennium Puzzle. Place the square base of the Puzzle inside the Arena in the center of the board.

The Slider Reader

The Yugioh board game uses a unique system to let your monsters battle.

Each character comes with its own Slider Reader, and each reader has several small windows punched through it. When you place a Monster Slider into the reader, numbers will appear through the windows. These are your Battle Numbers. Battle Numbers tell you how many times you get to roll the green and blue Battle Dice when attacking another player's monster—the color of each number determines how many times you get to roll the same-colored dice. The more times you get to roll, the more chances you have to hit. Whichever monster scores the most hits in a battle wins, See Battling below.

Each Slider Reader is unique. Putting the same Monster Slider in different readers will give you different Battle Numbers. You will soon discover that some monsters work better with certain characters than they do with others—you need to figure out which work best for you.

Now let's take a walk through the game.

Overview

In order to become Game Master Supreme, players must obtain all five pieces of the Millennium Puzzle. Each player begins the game with one piece of the puzzle; the final piece awaits them in the Arena. Players may not attempt to win the final piece until they have captured the other four.

In order to win puzzle pieces, players must challenge each other to battles in the Arena. To win these battles, players need powerful monsters; they can gather monsters by visiting the Card Shops located at the four corners of the board or by challenging other players to battles outside the Arena.

Battles outside the Arena are always fought for Monster Sliders—the loser must forfeit their Monster Slider to the winner.

Battles fought inside the Arena are always fought for pieces of the Millennium Puzzle—the loser must forfeit all pieces of the Millennium Puzzle they possess to the winner. See Battling below.

Players can also collect Trap Tiles outside the Arena. These tiles grant players special powers that they can use in their battles. See Trap Tiles below.

Once a player has collected all four pieces of the Millennium Puzzle from the other players, they may travel to the Arena and attempt to win the final puzzle piece. The other players choose which of them is strong enough to defend the final piece. That player travels to the Arena and then the battle commences.

Ready to play?

Here We Go!

Each player rolls the numbered die, re-rolling any ties. Highest roll goes first. Play proceeds around the table to the left.

The first player rolls the numbered die and may move up to the number of spaces rolled on the die. Players do not have to move the full number of spaces rolled. See Movement below.

Whenever a player lands on a space with the Trap symbol, they may draw one Trap Tile from the deck. Players may have no more than 4 Trap Tiles in their hand at any time—if they have more, they must discard the extras to the bottom of the Trap deck without playing them. See Trap Tiles below.

Whenever a player enters any Card Shop they may draw one Monster Slider from the pile of sliders in that Shop. Players may have no more than Monster Sliders in their hand at any time. Whenever they gain more than three, they must discard one, placing it at the bottom of the Monster deck in the store that matches their character's color. See Monster Sliders below.

When outside the Arena, if a player lands in a space adjacent to another player's mover, the moving player may choose to battle their opponent. This is accomplished by declaring that they wish to battle, then drawing a Battle Card. The Battle Card will tell the players what sort of game they must play to resolve their battle—this may be either Janken (Rock, Paper, Scissors), Ikusa (War), or Saikoro (Dice). The loser of the battle must give his losing Monster Slider to the winner. See Battling below.

When inside the Arena, a player may challenge any other player on the board fro their Millennium Piece(s). The challenged player immediately moves their mover into the Arena, and their monsters do battle. The loser gives their puzzle pieces to the winner. After the battle, both players return their movers to their opponent's home Card Shops. See Battling below.

The first player to collect all five pieces of the Millennium Puzzle is the winner.

Movement

Although players never have to move the full number of spaces they roll on the numbered die, they must always move at least one space on their turn. They may not end their move on the same space they started from.

Players may not move diagonally.

Two movers cannot share the same space unless they are in a Card Shop or in the Arena.

Movers may only enter or exit a Card Shop through the door space.

If another mover blocks your way (such as in the door space of a Card Shop) you must move to the next available space.

Movers may enter the Arena from any space that borders it—the Arena has no door. Players may not enter or move through the Arena unless they are battling for a puzzle piece.

Picking up a Monster Slider or Trap Tile, or Battling another player ends a player's movement.

Trap Tiles

Players begin the game with 2 Trap Tiles. Whenever a player lands on a space marked with a Trap symbol, they may draw another Trap Tile. They may not have more than 4 Trap Tiles in their hand at a time—if they have more, they must discard the extras without using them, placing them at the bottom of the Trap deck.

Trap Tiles can be played the same turn they are picked up. Players can play as many Trap Tiles as they possess in a single turn unless otherwise noted on the Tile.

To use a Trap Tile, turn it face-up on the table and follow the directions on the cad. Trap Tiles give you special abilities that you can use when battling your opponents.

The number in the upper right corner of the card is its Ikusa Number. This number is used to determine the outcome of an Ikusa Battle. See Battling below.

Monster Sliders

Players begin the game with 1 Monster Slider and may have no more than 3 in their hand—if they have more they must discard the extra at the bottom of the pile of Monster Sliders in their Card Shop.

Players use Monster Sliders to battle other players. Each slider is covered with a seemingly random jumble of Battle numbers, but once you insert a Monster Slider into your reader, the reader identifies which Battle Numbers apply to you.

You may only swap Monster Sliders out of your reader when it is your turn. This means that if another player challenges you to a battle on their turn, you must fight with whatever Monster Slider is already in your reader.

Battling

Players battle each other to win Monster Sliders and pieces of the Millennium Puzzle. There are two different types of battles depending on where they take place:

Battles Outside the Arena

When two players battle outside the Arena, they compete for Monster Sliders. The loser of the battle must forfeit the Monster Slider in their reader to the victor. If the loser has no Monster Slider, they must forfeit a Trap Tile to the victor. If the loser has no Trap Tiles, then they lose their next turn.

To battle, the challenger moves into a space adjacent to the player they wish to battle. Note: you cannot battle inside Card Shops and you may only battle once per turn.

The challenger draws a Battle Card and turns it face-up on the table. There are 3 types of Battle Cards that tell you what kind of battle must be fought:

Janken (Rock, Paper, Scissors)

Ikusa (War)

Saikoro (Dice)

Janken

Janken is played just like the old game of "Rock-Scissors-Paper". Both players make fists and shake them in time with each other. However, in this version of the game, the players chant "Jan", "Ken", "Pon" as they shake their fists. Upon saying "Pon" the players simultaneously reveal their hand symbols.

Rock beats scissors, scissors beats paper, and paper beats rock.

In the event of a tie, the players repeat the process until someone wins.

Ikusa

To play Ikusa, the battling players shuffle the Trap Tiles they have gathered and fan them out in front of them, face-down. Each chooses a tile for their opponent and flips it over on the table in front of their opponent. Compare the Ikusa Numbers in the top right-hand corner of the tiles—the highest number wins.

If a player has no Trap Tiles, they automatically lose.

Saikoro

Saikoro is a Monster Battle like the ones fought in the Arena. See Monster Battle below.

Winning a Battle Outside the Arena

The loser of any of the three battles listed above forfeits the Monster Slider in their reader to the victor.

If the victor already has 3 monsters, they must choose one Monster Slider to discard. The discarded slider goes to the bottom of the deck of Monster Sliders in the Shop that matches the winning player's color.

After battling, the turn is over.

Battles Insider the Arena

To battle for a piece of the Millennium Puzzle, a Player must enter the Arena or use a Duel Tile from the Trap Deck.

When a player enters the Arena, they may summon any other player to the Arena to battle for their piece(s) of the Millennium Puzzle. This battle is always fought with Monster Sliders.

Battling with Monsters

Each player looks at the Monster Slider in their Reader to determine how many and which colored Battle Dice they may roll. The colored numbers that appear through the windows of the reader let players know which color die to roll and how many times to roll it.

Battle Dice come in two colors: blue and green. The green die gives a much greater chance of hitting because it has more "Hit" symbols than the blue die.

Each players rolls the appropriate number and types of dice. The player who rolls the most hits wins. In the vent of a tie, players re-roll all of their Battle Dice again.

The loser of an Arena battle forfeits all Millennium Puzzle pieces they hold to the victor. If the loser has no puzzle pieces, they forfeit the Monster Slider from their reader.

If a player has more than one puzzle piece and wishes to save some of them after losing an Arena battle, they may sacrifice Monster Sliders to protect them. For each Monster Slider they discard from their hand—starting with the one in their reader—they may keep one of their Millennium Puzzle pieces. Discarded Monster Sliders are forfeited to the winner of the Battle (the winner must still discard down to three Monster Sliders).

Winning the Game

Play proceeds until one player has gathered four pieces of the Millennium Puzzle from the other players. At that point, the player travels to the Arena and attempts to win the final piece of the puzzle.

The other players decide which of them has the most powerful Monster and Trap Tiles to use and sends that player to defend the final puzzle piece. The two players battle each other with their Monster Sliders as described above.

Note: You cannot win the final piece of the Millennium Puzzle unless you are the challenger.

The first player to win all five of the puzzle pieces wins the game!

EXAMPLE II

YUGIOH Game Master Supreme Board Game

General Description

Who will be the first to obtain all five pieces of the Puzzle and in turn become winner of the game? In this turn based action board game, players find themselves assuming the roles of various characters and battling each other in hopes of gaining all the pieces of the Puzzle. Each player begins the game with a piece of the Puzzle with the final piece lying in the center of the board. Players navigate across the board trying to reach the last piece of the puzzle. By landing on certain marked spaces, Players can pick up either new coded cards or item cards, depending on the type of space landed upon. Item cards allow players to augment their character, while coded cards are the cards that facilitate battle. A battle dueled outside of the designated Dueling Arena results in the win or loss of one's coded card. When dueling in the Arena, the stakes are raised and the pieces of the Puzzle are at risk. First player to acquire all five pieces of the Puzzle wins!

Contents (2) Blank sided dice with sticker applications instead of pips (1) Green (3 hit and 3 miss stickers)

(1) Blue (1 hit and 5 miss stickers)

(1) Six-sided die with pips 1–6

(1) 18.5"×18.5" levant 0.58 case wrapped game board (4) Character specific card readers or decoders (4) Molded movers
- Character 1 (Purple)
- Character 2 (Grey)
- Character 3 (Blue)
- Character 4 (Green)

(28) Trap Tiles/Item Cards

(24) Monster Sliders/Coded Cards (3) Battle Cards

Instruction sheet

Set up package

The Object

Be the first player to obtain all five pieces of the Puzzle.

Game Play

Up to 4 Players around board at a table

Players roll six-sided numbered die to determine who goes first. Highest roll wins. Game play continues clockwise from First Player.

Players start with 1 coded card, 2 item cards and a piece of the puzzle.

The fifth piece of the puzzle is placed in the center of the board.

a player may only challenge for the fifth and final piece after obtaining the other 4 pieces of the puzzle.

Player 1 takes the six-sided die and rolls. Player 1 can move up to the number of spaces rolled on the die Picking up a coded or item card or battling another player ends player's movement.

A player's hand can consist of at most 4 item cards.

Item cards can be played the same turn they are picked up. Players can play as many item cards as they possess in a single turn unless otherwise noted on item cards.

Players may corral up to 3 coded cards for battle use.

To battle, players must be in an adjacent space to player they wish to duel.

Battling is facilitated by choosing a battle cards. There are 3 types of battle cards:
- Janken (Rock, Paper, Scissors)
- Ikusa (War)
- Saikoro (Dice)

Janken is played by both players shaking their fists in time and chanting "Jan", "Ken", "Pon" upon saying "Pon" the players will reveal their hand symbols.
- In event of a tie, Players repeat until a winner is determined.

Saikoro is played just like a duel. (see duel instructions below)

Ikusa is played by each player shuffling their item cards and fanning them out to let their opponent choose a card for them. The numbers at the top of the cards are read and who ever has the highest the highest number is the winner.
- If a player has no cards, they automatically lose.
- In event of a tie, players re-shuffle cars and draw again.
- If Player 1 wins then Player's 2 monster is forfeited to Player 1.
- If Player 1 already has 3 monsters, Player 1 may decide which monster to discard.

After battling, Player 1's turn is over.

To Duel for a piece of the puzzle, a Player must enter the dueling arena or use a dueling card from the item deck.
- By entering the dueling arena, Player 1 is able to summon any of the other players to the arena to duel for a piece of the puzzle.
- Battle is facilitated by sliding the coded reader into the character card reader or decoder to determine how many and which colored dice a player may roll.
- Players roll the appropriate number and types of dice. If the Player 1 has more hits on the dice than Player 2, then Player 1 wins and Player 2's monster is forfeited to Player 1.
- In event of a tie, players re-roll dice.

At the end of the turn, play continues clockwise from last player.

EXAMPLE III

Yu-Gi-Oh! Millennium Game—Juego—Jen

Game Contents

1 Game Board

1 Six-sided numbered die 2 duel dice
- 1 Dice label sheet
- 1 Green die
- 1 Blue die 4 Character movers
- 1 Yugi (Red)
- 1 Kaiba (Blue)
- 1 Mai (Yellow)
- 1 Joey (Green)

4 Slider Readers
- 1 Yugi
- 1 Kaiba
- 1 Mai
- 1 Joey

28 Trap Tiles

24 Monster Sliders

3 Battle Cards

5 Millennium Puzzle Pieces

Label Application Instructions

Match the blue and green-colored Duel Dice to the same-colored dice labels. Peel the labels and apply one to each side of the same-colored die. It does not matter which label goes on which side, only that blue labels are applied to the blue die, and green to the green die.

The Object

Gather powerful monsters and duel other players in the Arena to win their piece of the Millennium Puzzle. The first player to obtain all vice pieces wins the game.

Game Set-Up

- Open the game board in the center of the playing area.
- Place all of the Slider Readers on the playing area with the character labels facedown. Each player draws one, youngest player first. The character on the back of the Slider Reader they draw assigns the mover they will use. Note: The color of a mover's base denotes that player's home Game Shop.
- All players' movers start in the Arena.
- Shuffle the Monster Sliders and place them beside the board.
- Shuffle the Trap Tiles and deal 7 to each of the four Trap Tile spaces on the board.
- Shuffle the three Battle Cards and place them beside the Monster Sliders.
- Each player takes on of the four triangular pieces of the Millennium Puzzle. Place the square base (and any remaining pieces of the Puzzle if less then four people are playing) on the grassy spaces around the Arena.

Overview

In order to become the King of Games, players must obtain all five pieces of the Millennium Puzzle. Each player begins the game with one piece of the puzzle; the final piece (or pieces if fewer than four people are playing) awaits them in the Arena. Players may not attempt to win the final piece until they have captured the other four.

In order to win the puzzle pieces, players challenge each other to duels in the Arena. Players need powerful monsters to win these Arena Duels; they gather monsters by visiting the Game Shops located at the four corners of the board or by winning battles outside the Arena.

Battles take place outside the Arena and are always fought for Monster Sliders the loser must forfeit their Monster Slider to the winner.

Arena Duels take place in the Arena and are always fought for pieces of the Millennium Puzzle—the loser forfeits all pieces of the Millennium Puzzle they possess to the winner (See ARENA DUELS).

Players also collect Trap Tiles outside the Arena. These tiles grant players special powers they can use in battle. (See TRAP TILES).

Once a player collects all the puzzle pieces from their opponents they may travel to the Arena and attempt to win the final puzzle piece(s). The remaining players choose the strongest among them to defend the final piece. That player travels to the Arena and the duel commences.

The first player to capture all five pieces of the Millennium Puzzle is the winner.

Let's Play

- Each player rolls the numbered die re-rolling any ties. Highest roll goes first. Play proceeds around the table to the left.
- The first player rolls the numbered die and may move up to the number of spaces rolled on the die. Players do not have to move the full number of spaces rolled. (See MOVEMENT).
- Whenever a player lands on a space with the Trap symbol, they may draw one Trap Tile from the desk (See TRAP TILES).
- Whenever a player enters any Game Shop they may draw one Monster Slider from the pile. (See MONSTER SLIDERS).
- When outside the Arena, if a player stops in a space adjacent to another player's mover, the moving player may choose to battle their opponent. This is accomplished by declaring that they wish to battle, then drawing a Battle Card. (See BATTLING).
- When inside the Arena, a player may challenge any other player on the board for their Millennium Piece(s). The challenged player immediately places their mover in the Arena, and their monsters duel. The loser gives all puzzle pieces in their possession to the winner. After the duel, both players place their movers in their opponent's home Game Shop and draw a Monster Slider. (See BATTLING).
- The first player to collect all five pieces of the Millennium Puzzle is the winner.

The Slider Reader

The Yu-Gi-Oh!™ Millennium™ Game uses a unique system to let your monsters battle.

Each character comes with its own Slider Reader, and each Reader has 2 small windows. When you place a Monster Slider into the Reader, numbers will appear through the windows. These are your Duel Numbers. Duel Numbers tell you how many times you get to roll the green and blue Duel Dice when attacking another player's monster. The Green number tells you how many times to roll the Green Die and the Blue number how many times to roll the Blue Die. The more times you get to roll, the more chances you have to hit. Whichever monster scores the most hits in a duel wins. (See ARENA DUELS).

Each Slider Reader is unique. Putting the same Monster Slider in different Readers will give you different Duel Numbers. You will soon discover that some monsters work better with certain characters than they do with others—you need to figure out which work best for you.

Movement

- Although players never have to move the full number of spaces rolled on the numbered die, they must always move at least one space on their turn. They may not end their move on the same space they started from.
- Players may move diagonally.
- Two movers cannot share the same space unless they are in a Game Shop or in the Arena.
- Movers may enter the Arena (or exit, on their first turn) from any space bordering the Arena. They may not move through the grassy spaces on either end. Players may not enter or move through the Arena unless they are dueling for a puzzle piece.
- Movers may only enter or exit a building, including Game Shops, through door spaces. All door spaces are highlighted yellow.
- Players may not visit the same Game Shop or Trap Symbol twice in a row.
- If another mover or movers block your way, move to the next available space.
- Picking up a Monster Slider or Trap Tile, or Battling or Dueling another player ends a players movement.

Trap Tiles

- Whenever a player lands on a space marked with a Trap symbol, they may draw a Trap Tile from the pile within that building. If the Trap Tiles in that building are all gone, players may not draw from the piles in other buildings. They may not have more then 4 Trap Tiles in their hand at a time—if they have more, they must discard the extras without using them, placing them at the bottom of any Trap deck.

Trap Tiles can be played the same turn they are picked up. Players can play as many Trap Tiles as they possess in a single turn.

The number in the upper right corner of the card is its Ikusa Number. This number is used to determine the outcome of an Ikusa Battle. (See BATTLING).

To use a Trap Tile, turn it face-up on the table and follow the directions on the card.

+1 Hit—Add 1 to the total number of hits rolled on the Duel Dice.

1 Miss Equals 2 Hits—Count 1 miss rolled on the Duel Dice as 2 hits.

Note: You must roll a miss to use this card.

Take another turn—Play this card at the end of your turn to go again.

Monster Swipe—Swap any of your Monster Sliders for one of your opponent's Sliders that is not in their Reader. You may not look at any of their facedown Sliders when choosing. If your opponent only has one Slider, you may not use this Trap Tile against them.

Arena Duel—Instantly transport you and an opponent to he Arena for a duel.

Instant Battle—When outside the Arena, move on opponent to a space adjacent to your mover. Battle automatically begins.

Open Eye—Look through an opponent's Trap Tiles and take one. If this brings the total in your hand above four, discard a Tile of your choice.

Move Twice Your Roll—Multiply your roll on the movement (numbered) die by 2. Note: This can be played AFTER the movement die is rolled.

Lose a Turn—Play this card on an opponent—they lose their next turn.

Monster Sliders

Players only use Monster Sliders to duel other players in the Arena. A seemingly random jumble of Duel Numbers covers each Slide, but once you insert Sliders into your Reader, the Reader identifies which Duel Numbers apply to you.

Players may keep no more than 3 Monster Sliders at a time—if they have more they must discard the extra at the bottom of the Monster Slider deck.

The Monster Slider in your Reader must be left face-up for the other players to see. Additional Sliders in your hand can be left face down.

You must always keep a Monster Slider in your Reader unless you don't have any Sliders left. When you are defeated in a battle, your opponent takes the Monster Slider from your Reader—you must immediately replace it with any Slider in your hand (unless you have no more Sliders) before the next player's turn begins.

You may only swap Monster Sliders from your Reader when it is your turn. Once you begin an Arena Duel you may not swap a Slider even if it is your turn. If another player challenges you to an Arena Duel on their turn, you must fight with whatever Monster Slider is already in your Reader.

Battling

Battles take place outside the Arena and allow players to win their opponent's Monster Sliders.

To challenge another player to a battle, the challenger must have a Monster Slider. A battle occurs when the challenger stops on a space adjacent to the player they wish to battle. Note: you cannot battle inside Game Shops and you may only battle once per turn.

The challenged player shuffles the Battle Cards and the challenger draws one, turning it face-up on the table. There are 3 types of Battle Cards that identify the type of battle to be fought.

Janken

Janken is played just like the game of "Paper-Rock-Scissors". Both players make fists and shake them in the air in time with each other. However, in this version of the game, the players chant "Jan", "Ken", "Pon", shaking their fists in time with each word. Upon saying "Pon" the players simultaneously reveal their hand symbols.

Paper beats rock, rock beats scissors, and scissors beats paper.

In the event of a tie, the players repeat the process until someone wins.

Ikusa

To play Ikusa, the battling players shuffle the Trap Tiles they have gathered and fan them out in front of them, facedown, Each chooses a tile for their opponent, drawing it from their opponent's hand, and flips it over in front of their opponent. Challenger chooses first. Compare the Ikusa Numbers in the top right-hand corner of the tiles—the highest number wins.

If a player has no Trap Tiles, they automatically lose. If neither player has a Trap Tile, draw a different Battle Card.

SaiKoro

Saikoro is a Dice Battle.

Each player rolls both Duel Dice 3 times, challenger first, and counts the number of hits rolled. Re-roll any ties. The player who scores the most hits wins.

Winning a Battle

When two players battle outside the Arena, they compete for Monster Sliders. The loser of the battle must forfeit the Monster Slider in their Reader to the victor. If the loser has no Monster Slider, they must forfeit a Trap Tile to the victor. If the loser has no Trap Tiles, then they lose their next turn.

If the victor already has 3 monsters, they must choose one Monster Slider to discard. The discarded Slider goes to the bottom of the deck of Monster Sliders.

Additionally, the victor draws one new Trap Tile from the Trap Deck. If this brings their total above four, they must discard one Tile to the bottom of the deck.

After battling, the turn ends.

Arena Duels

To duel for a piece of the millennium Puzzle, a Player must enter the Arena or use an Arena Duel Tile from the Trap Deck to travel there.

When a player enters the Arena, they may summon any other player to the Arena to duel for their piece(s0 of the Millennium Puzzle. This duel is always fought with Monster Sliders.

Dueling With Monsters

Each player looks at the Monster Slider in their Reader to determine how many and which colored Duel Dice they may roll. The colored numbers that appear through the windows of the reader let players know which color die to roll and how many times to roll it.

Duel Dice come in two colors: blue and green. The green die gives a much greater chance of hitting because it has more "Hit" symbols then the blue die.

Each player rolls the appropriate number and types of dice. The player who rolls the most hits wins. In the event of a tie, players re-roll all of their Duel Dice again.

The loser of an Arena Duel forfeits all Millennium Puzzle pieces they hold to the victor. If the loser has no puzzle pieces, they forfeit the Monster Slider from their Reader.

After dueling inside the Arena, players travel to the home Game Shop of their opponent. Both combatants draw a new Monster Slider. The winner draws first.

Winning the Game

Play proceeds until one player has gathered all pieces of the Millennium Puzzle from the other players. At that point, the player travels to the Arena and attempts to win the final piece(s) of the puzzle. The challenger risks all pieces they have collected thus far for the puzzle piece(s) located in the Arena.

The other players decide which of them has the most powerful Monster Slider loaded in their Reader and the best Trap Tiles in their hand and sends that player to defend the final puzzle piece. The two players duel each other with their Monster Sliders as described above.

If the challenger wins the duel, they take the final piece of the puzzle from the Arena.

If the defending player wins, they take all the pieces of the puzzle from the challenger. They do not win the piece(s) held in the Arena.

The first player to win all five of the puzzle pieces wins the game!

Winning 2 and 3-Player Games

If you are playing a 2 or 3-player game, the Arena will contain more than one puzzle piece. You must win each Arena piece one at a time, and you may only do so after capturing all other puzzle pieces from the opposing players.

It is believed that the disclosure set forth above encompasses multiple distinct inventions with independent utility. While each of these inventions has been disclosed in its preferred form, the specific embodiments thereof as disclosed and illustrated herein are not to be considered in a limiting sense as numerous variations are possible. The subject matter of the inventions includes all novel and non-obvious combinations and subcombinations of the various elements, features, functions and/or properties disclosed herein. Similarly, where the claims recite "a" or "a first" element or the equivalent thereof, such claims should be understood to include incorporation of one or more such elements, neither requiring nor excluding two or more such elements.

Inventions embodied in various combinations and subcombinations of features, functions, elements and/or properties may be claimed through presentation of new claims in a related application. Such new claims, whether they are directed to a different invention or directed to the same invention, whether different, broader, narrower or equal in scope to the original claims, are also regarded as included within the subject matter of the inventions of the present disclosure.

We claim:

1. A game system comprising:

a game card having a plurality of possible probability influencing indicia;

a decoder configured to select at least one of the probability influencing indicia from the game card; each decoder configured to have apertures and to reveal through the apertures a player specific code by selecting at least one of the probability influencing indicia, when the decoder is super imposed on a game card; and a value generator configured to generate a value based on the selected probability influencing indicia, wherein the generated value determines a winner; wherein the value generator includes a pair of dice having sides marked with one of a hit indicator and a no hit indicator; and the value is determined by the presence of a hit indicator.

2. The game system of claim 1, further including a plurality of game cards and a plurality of decoders.

3. The game system of claim 2, further including a plurality of player pieces each associated with a specific one of the plurality of decoders.

4. The game of claim 2, wherein each decoder includes a slot for receiving a game card.

5. The game of claim 4, wherein:

each of the game cards includes a game card icon; and each decoder includes a character window for displaying the game card icon.

6. The game system of claim 1, wherein the probability influencing indicia includes a number of times the die is rolled in order to generate the value.

7. The game system of claim 6, wherein the winner is determined by comparing values generated by a pair of competing players.

8. The game system of claim 1, wherein:

a first die of the pair of dice has three sides marked with a hit indicator; and a second die of the pair of dice has two sides marked with a hit indicator.

9. The game system of claim 1, wherein:

a first die of the pair of dice has four sides marked with a hit indicator; and a second die of the pair of dice has three sides marked with a hit indicator.

10. The game system of claim 1, wherein:

a first die of the pair of dice has a first number of sides; and a second die of the pair of dice has a second number of sides.

11. The game system of claim 10, wherein:

the first number of sides is smaller than the second number of sides; and the first die and second die have the same number of sides marked with a hit indicator.

12. The game system of claim 11, further including a set of item cards configured to enhance the play of the game.

13. The game of claim 12, further including a set of puzzle pieces configured to be collected during play of the game.

14. The game of claim 13, wherein collecting the puzzle pieces includes engaging in and winning battles.

15. The game of claim 14, wherein the battles that may be engaged in include game card battles, item card battles, and hand signal battles.

16. game of claim 15, wherein winning the game includes collecting all of the puzzle pieces.

17. A game for a plurality of players comprising:

a set of game cards having a plurality of possible probability influencing indicia printed thereon;

a player-specific decoder for each of the plurality of players configured to reveal a player-specific code by selecting at least one of the probability influencing indicia from one of the game cards from the set when the selected game card is read by the decoder; each decoder configured to have apertures and to reveal through the apertures a player specific code by selecting at least one of the probability influencing indicia, when the decoder is super imposed on a game card;

a game board having an array of spaces;

a plurality of player pieces each associated with one player-specific decoder;

wherein each player piece is distinguishable from the other player pieces and configured to mark one of the spaces in the array of spaces on the game board;

a set of item cards configured to alter the play of the game;

a set of puzzle pieces configured to be collected during play of the game and a value generator configured to generate values during a game card battle.

18. The game of claim 17, wherein collecting the puzzle pieces includes engaging and winning battles.

19. The game of claim 18, wherein the battles that may be engaged in include game card battles, item card battles, and hand signal battles.

20. The game of claim 19, wherein winning the game includes collecting all of the puzzle pieces.

21. A board game for play by a plurality of players comprising:

a game board having an array of spaces;

a set of puzzle pieces;

a random number generator configured to generate a number of spaces that a player may move on the game board during a turn;

a plurality of distinguishable player pieces configured to be used by one of a plurality of players in playing a game;

a plurality of player-specific decoders each decoder associated with one of the plurality of player pieces; each decoder configured to have apertures and to reveal through the apertures a player specific code by selecting at least one of the probability influencing indicia, when the decoder is super imposed on a game card;

a set of coded game cards having a plurality of possible probability influencing indicia printed thereon and configured to be decoded by each player-specific decoder to reveal a player-specific code for use in game card battles; and at least one value generator configured for conducting game card battles, wherein the game card battles include:

selecting a coded game card and decoding the selected game card to reveal a player-specific code that governs the use of the at least one value generator during a game card battle.

22. The board game of claim 21, including a set of item cards configured to affect the play of the game.

23. The board game of claim 22, further including a set of battle cards configured for selecting a battle type from a set of battle types, wherein the set of battle types may include dice battles, item card battles, and hand signal battles.

24. The board game of claim 23, wherein the array of spaces includes a plurality of game-card shop spaces, a plurality of item card spaces, and a plurality of battle arena spaces.

25. A method of playing a game for a plurality of players comprising:

providing each player at least one game card having a plurality of possible probability influencing indicia;

assigning player-specific decoders configured to select at least one of the probability influencing indicia from the game card; each decoder configured to have apertures and to reveal through the apertures a player specific code by selecting at least one of the probability influencing indicia, when the decoder is super imposed on a game card;

decoding a game card with a player-specific decoder to reveal a probability influencing indicia; and generating values using a value generator configured to generate a value based on the selected probability influencing indicia, wherein the value generator creates a number of hits scored during a game card battle and the winner scores more hits during a game card baffle than a loser and wherein the winner of a game card battle takes the game card from the loser.

26. The method of claim 25, further including:

providing a game board having battle arena spaces;

providing a set of puzzle pieces initially distributed equally between the plurality of players, and engaging in game card battles while playing pieces are positioned on battle arena spaces, wherein:

the winner of the game card battle takes all the puzzle pieces the loser possesses.

27. The method of claim 26, wherein winning the game is accomplished by collecting all of the puzzle pieces.

* * * * *